US005918100A

United States Patent [19]

Tanaka et al.

[11] Patent Number: 5,918,100

[45] Date of Patent: Jun. 29, 1999

[54] COPY SHEET GUIDE STRUCTURE FOR USE IN IMAGE FORMING APPARATUS

[75] Inventors: Shinichi Tanaka; Takeshi Uemura, both of Osaka, Japan

[73] Assignee: Mita Industrial Co., Ltd., Osaka-fu, Japan

[21] Appl. No.: 08/971,925

[22] Filed: Nov. 10, 1997

[30] Foreign Application Priority Data

Nov. 12, 1996 [JP] Japan ..... 8-300462

[51] Int. Cl.[6] ..... G03G 15/00

[52] U.S. Cl. ..... 399/361; 271/274; 399/110

[58] Field of Search ..... 399/397, 388, 399/361, 394, 110; 271/272, 273, 274, 188, 209

[56] References Cited

U.S. PATENT DOCUMENTS 1,437,843 12/1922 Heinrichs ..... 271/274

4,408,861 10/1983 Hukuda et al. ..... 271/274 X 5,091,754 2/1992 Abe et al. ..... 399/394

5,326,092 7/1994 Ando ..... 271/272

5,368,290 11/1994 Nanba et al. ..... 271/273

5,443,255 8/1995 Nanba et al. ..... 271/273

*Primary Examiner*—S. Lee

*Attorney, Agent, or Firm*—Jordan and Hamburg LLP

[57] ABSTRACT

This invention relates to a copy sheet guide structure for use in an image forming apparatus. Plural copy sheet guide structures constitute a transport path along which a copy sheet is to be transported. At least one guide structure has a pair of guide members formed into such a shape to form a one piece unit when engageably assembled to each other. With this arrangement, fastening means for constructing the guide structure is not necessary. Further, sheet guiding ability of the copy sheet guide structure can be improved because the guide members are assembled to each other with high positional accuracy.

20 Claims, 6 Drawing Sheets

COPY SHEET GUIDE STRUCTURE FOR USE IN IMAGE FORMING APPARATUS

BACKGROUND OF THE INVENTION

1. Field of the Invention

This invention relates to an image forming apparatus in which an electrostatic latent image formed on a photoreceptor is developed into a toner image, and the toner image is transferred onto a copy sheet transported along a transport path, and to a copy sheet guide structure for use in such image forming apparatus.

2. Description of the Background Art

Generally, there have been known electrostatic type image forming apparatuses such as facsimile machine and copying machine comprising a charger, a developing unit, a transfer unit, and a cleaning unit that are arranged in the periphery of a photoreceptor, an exposure unit for exposing an image on the photoreceptor, and a copy sheet transport mechanism for supplying and transporting copy sheets.

The image forming apparatuses are operated such that the photoreceptor, the exposure unit, and the copy sheet transport mechanism are driven synchronously to sequentially perform operations of charging the photoreceptor, exposing an image on the photoreceptor, developing the exposed image, and transferring the image on a copy sheet transported from the copy sheet transport mechanism.

Further, the image forming apparatus are operated such that the copy sheet for image transfer is dispensed from a paper cassette by the copy sheet transport mechanism, and transported to a fixing unit along a specified transport path via the transfer unit, and the cleaning unit removes toner residues on the photoreceptor after the image transfer.

The conventional copy sheet transport mechanism used in the above image forming apparatus has adopted a guide structure constructed in the following manner. Specifically, the guide structure comprises plural (e.g., two) guide plates fixed on a main body of the apparatus to define a transport path therebetween. After one of the guide plates has been fixed on the apparatus main body by fastening means (e.g., screw), the other guide plate is fixed on the apparatus main body by fastening means as opposed to the already fixed guide plate apart by a certain clearance. Thereby, a guide space for guiding a copy sheet is defined between the two guide plates. The guide space partially constitutes the transport path.

The above conventional guide structure in which the guide plates are fixed on the apparatus main body by fastening means deteriorates workability in assembling the parts and becomes one of the factors for cost rise in producing the apparatus.

The conventional guide structure has another drawback. The finished state of the guide space, i.e., the result as to whether the guide space is shaped into an exact size, greatly affects smooth guiding of copy sheet (hereinafter also referred to as "sheet guiding ability"). The above conventional arrangement of defining the guide space by fixing the two guide plates individually on the apparatus main body makes it difficult to define the guide space with high precision, hence hindering improvement of the sheet guiding ability.

SUMMARY OF THE INVENTION

In view of the above drawbacks of the prior art, an object of this invention is to provide a copy sheet guide structure for use in an image forming apparatus having excellent assembling ability and sheet guiding ability.

To accomplish the above object, this invention is directed to a copy sheet guide structure for use in an image forming apparatus in which an electrostatic latent image formed on a photoreceptor is developed into a toner image, and the toner image is transferred onto a copy sheet transported along a specified transport path.

The guide structure comprises a pair of guide members arranged on the transport path, and the guide members are capable of being assembled together to form a one piece unit. And the guide members, when assembled together to put into the one piece unit, define a guide space to guide the copy sheet.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
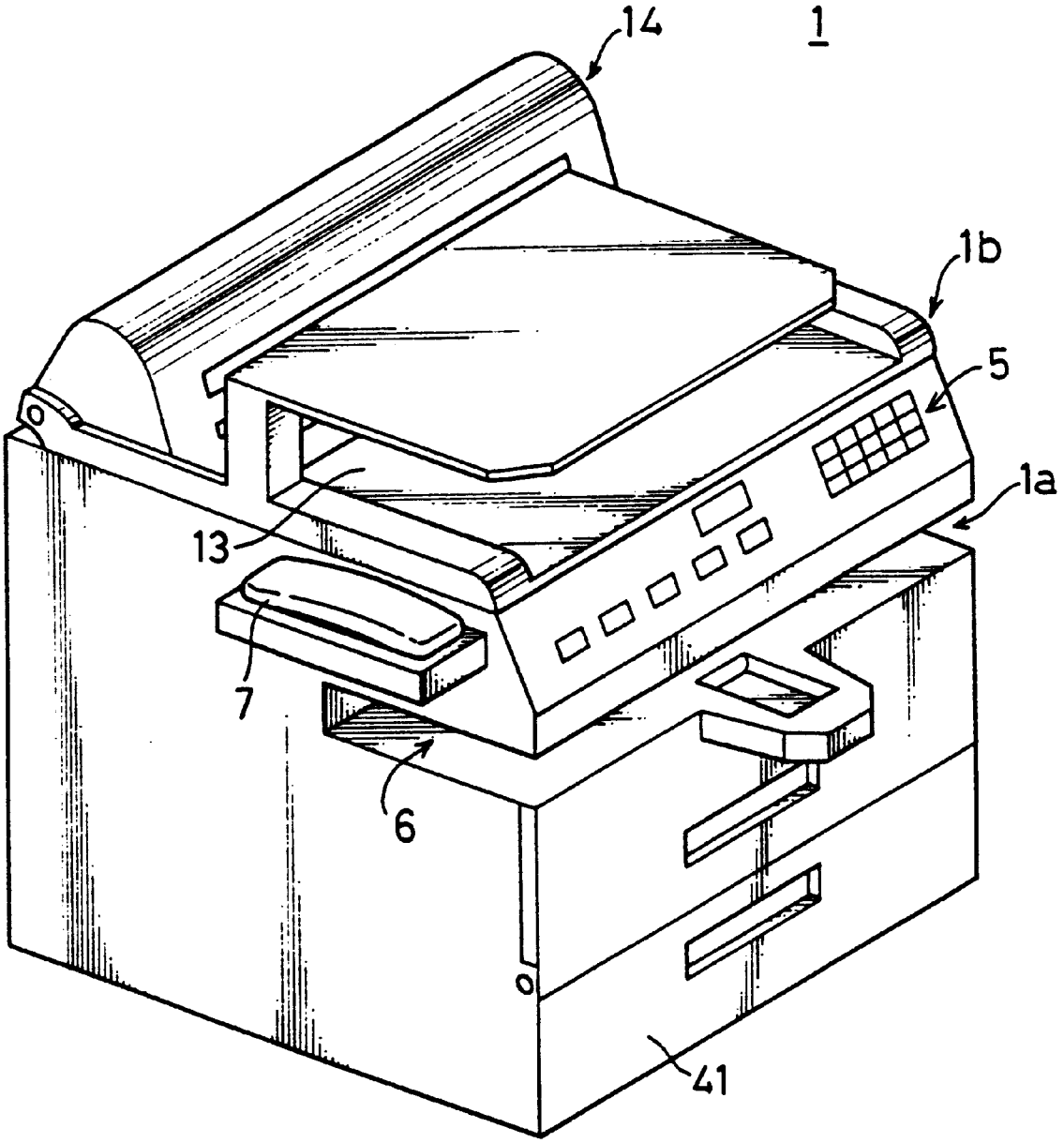
FIG. 1 is a perspective view showing an external appearance of an embodiment of an image forming apparatus according to this invention.
Figure 2:
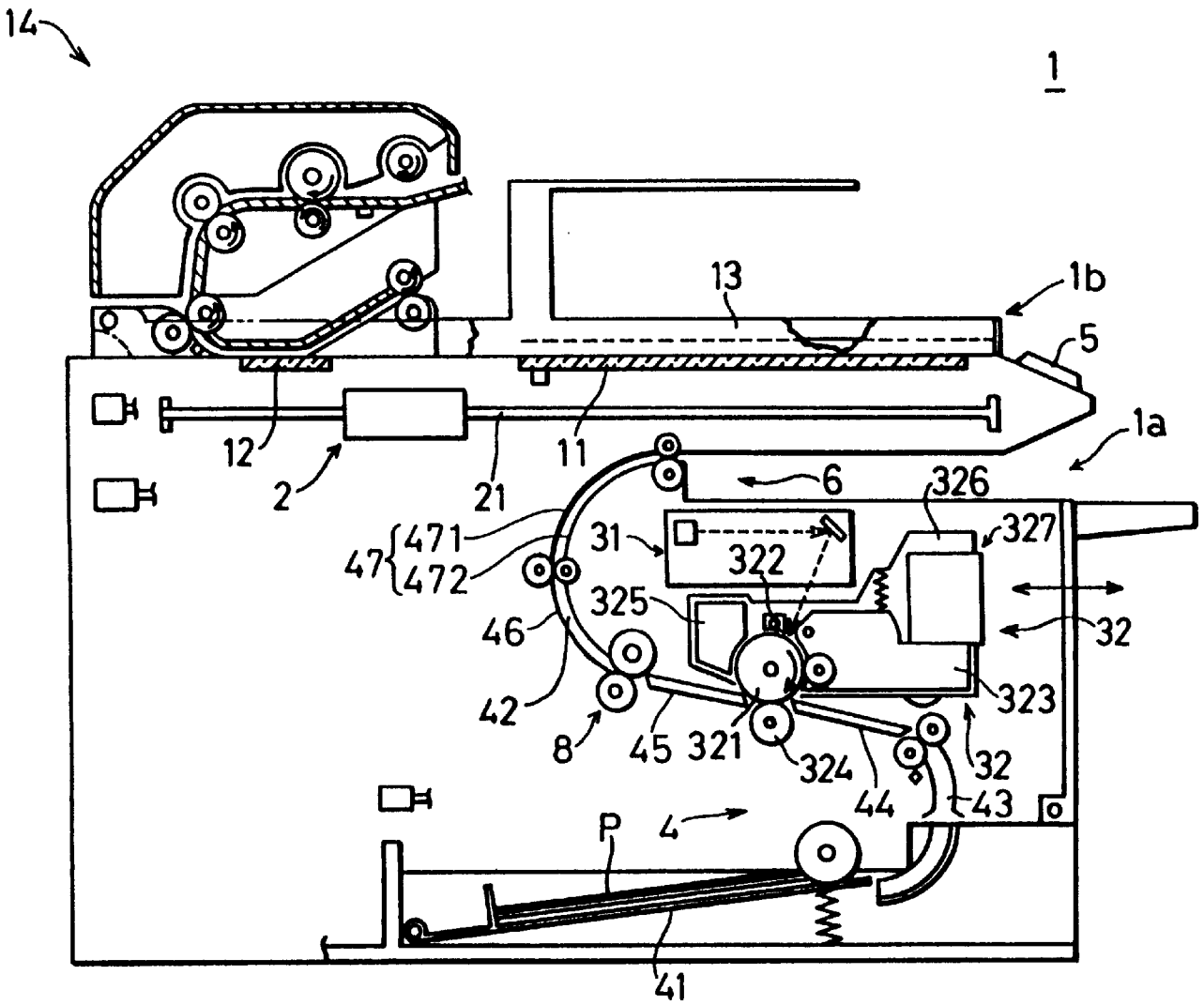
FIG. 2 is a diagram of an internal arrangement of the image forming apparatus.

Hereinafter, an embodiment of an image forming apparatus according to this invention is described with reference to the accompanying drawings. FIG. 1 is a perspective view showing an external appearance of the image forming apparatus embodying this invention. FIG. 2 is a diagram showing an internal arrangement of the image forming apparatus.

The image forming apparatus 1 is a compound machine having functions as facsimile machine and copying machine, and comprises a main body 1*a* and a document handling unit 1*b* disposed on the main body 1*a* for setting and feeding original documents.

The document handing unit 1*b* has a first contact glass 11 mounted at the top of the apparatus main body 1*a*, a second contact glass 12 mounted on the rear side (left side in FIG. 2) of the first contact glass 11, a document presser 13 disposed above the first contact glass 11 for covering the entire plane of the first contact glass 11 when closed, and an automatic document feeder 14 disposed above the second contact glass 12.

An image scanner 2 (image reader unit) is selectively operated such that it reads the image of an original document while moving relative to the document when the document is set on the contact glass 11 in a stationary state. On the other hand, when the original document is placed on the document feeder 14, the image scanner 2 reads the original image by feeding the document by rollers comprising the automatic document feeder 14, while pausing at a specified image scan position just below the second contact glass 12.

An operation panel 5 is arranged on the upper outer surface, on the front side (right side in FIG. 1) of the apparatus main body 1*a*. A copy sheet discharge unit 6 is provided on the upper portion of the apparatus main body 1*a*, extending half way through in a direction from the front side where the operation panel 5 is provided toward the rear side of the apparatus main body. A telephone 7 is provided on the side portion of the apparatus main body 1*a* to transmit and receive an image data to and from a facsimile machine (external device) via a telephone line.

It should be noted that, in this embodiment, copying operation and facsimile transmission/receiving are supposed to be performed on the side of the operation panel 5. Accordingly, the side where the operation panel 5 is provided is referred to as "afront side" of the apparatus main body 1*a*, whereas the opposite side is referred to as "rear side" throughout the description.

The apparatus main body 1*a* is internally provided with the image scanner (image reader unit) 2, an image recorder unit 3, and a copy sheet transport mechanism 4 that are assembled on a frame main body (not shown).

The image scanner 2 is disposed beneath the first contact glass 11 and the second contact glass 12, and is designed to read a stationary image of an original document while reciprocating relative to the document along a lateral side of the first and second contact glasses 11 and 12 (leftward and rightward direction in FIG. 2), and to read the image of an original document fed by the automatic document feeder 14 while pausing at the scan position just below the second contact glass 12.

As shown in FIG. 2, the image recorder unit 3 has an exposure unit 31 for exposing an image read by the image scanner 2 or an image (data) transmitted from an externally provided facsimile machine (external device), and an imaging assembly 32 with a photoreceptor 321. The exposure unit 31 is disposed below the copy sheet discharge unit 6 to form an electrostatic latent image on the photoreceptor 321 based on the image read by the image scanner or the image data transmitted from the external device.

The imaging assembly 32 has a charger 322, a developing unit 323, a transfer roller 324, and a cleaning unit 325 along a circumference of the photoreceptor 321. The electrostatic latent image formed on the photoreceptor 321 is developed into a toner image by the developing unit 323. Thereafter, the toner image is transferred onto a copy sheet P transported by the copy sheet transport mechanism 4 at a position opposing to the transfer roller 324.

Toner residues on the surface of the photoreceptor 321 are removed by the cleaning unit 325 at a position opposing thereto. The charger 322, the developing unit 323, and the cleaning unit 325 which constitute part of the imaging assembly 32 are accommodated in a housing 326 to constitute an imaging unit 327 as a whole. The imaging unit 327 is detachably mounted on a resin chassis (not shown) provided in the apparatus main body 1*a*.

The transport mechanism 4 is designed such that a copy sheet P is dispensed from a paper cassette 41 provided in the lower portion of the apparatus main body 1*a*, transported along a substantially S-shaped transport path 42 and discharged toward the copy sheet discharge unit 6 via the transfer roller 324.

Specifically, the transport path 42 is defined by a first pre-transfer guide 43, a second pre-transfer guide 44, a post-transfer guide 45, a first inverting guide 46, and a second inverting guide 47. The first pre-transfer guide 43 and the second pre-transfer guide 44 are adapted for inverting the transport direction of a copy sheet P which is dispensed from the paper cassette 41 through an outlet facing the right side in FIG. 2 to transport the copy sheet P between the photoreceptor 321 and the transfer roller 324.

The post-transfer guide 45 is adapted for transporting the copy sheet P after the image transfer on the photoreceptor 321 toward the fixing unit 8. The first inverting guide 46 and the second inverting guide 47 are adapted for inverting the transport direction of the copy sheet P which has passed the fixing unit 8 again to discharge the copy sheet P to the copy sheet discharge unit 6.

In this way, according to this embodiment, the guide members 43 to 47 define the transport path 42 to transport the copy sheet P in a specified direction stage by stage. Each of the guide members 43 to 47 is formed of a resin material or its equivalent, and is formed with plural ribs on a surface in contact with the copy sheet P. Each rib extends in the sheet transport direction and is spaced apart from each other by a certain interval to smoothly guide the copy sheet in the extending direction of the ribs.

Figure 3:
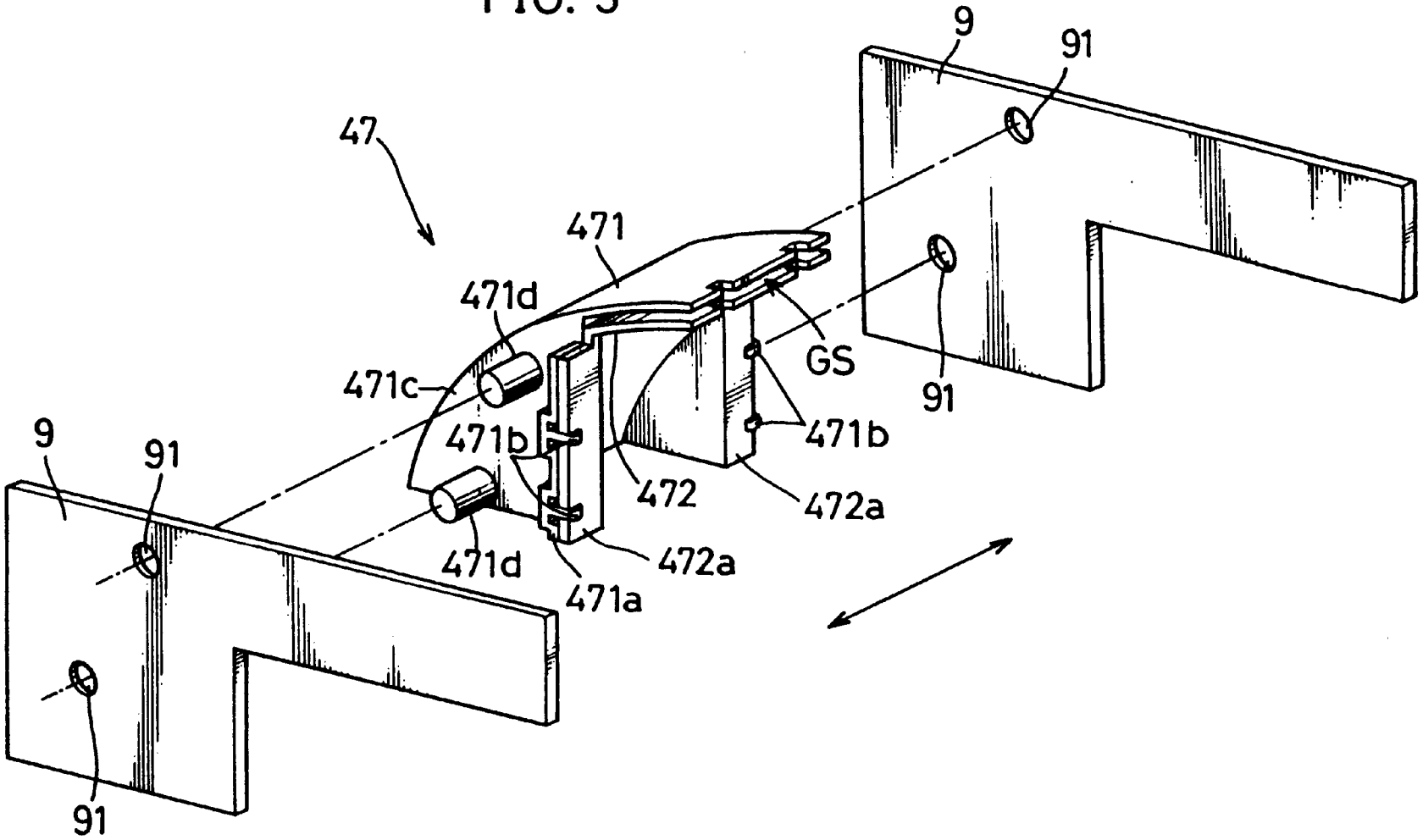
FIG. 3 is a perspective view of an arrangement of a second inverting guide.
Figure 4:
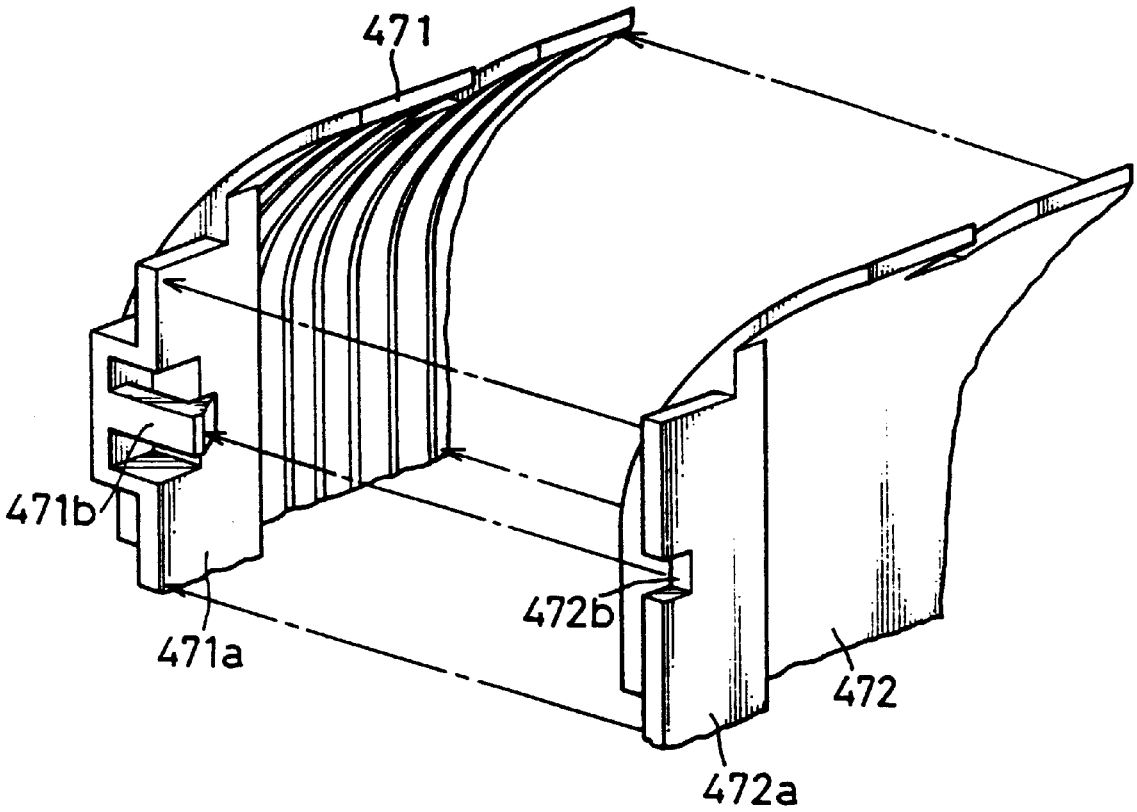
FIG. 4 is a partially enlarged exploded perspective view of the second inverting guide.

Hereinafter, the second inverting guide 47, as an example of the copy sheet guide structure according to this invention is described in detail. FIG. 3 is a perspective view showing an arrangement of the second inverting guide 47. FIG. 4 is a partially enlarged exploded perspective view of the second inverting guide 47.

As shown in FIGS. 3 and 4, the second inverting guide 47 comprises a pair of guide members 471 and 472 that are formed into such a shape as to form a one piece unit when the guide members 471 and 472 are assembled to each other. When the guide members 471 and 472 are engageably assembled to each other, a guide space GS is defined therebetween to guide a copy sheet.

The guide member 471 is formed with a flange portion 471*a* at opposite ends thereof in the direction of arrow in FIG. 3 (in the widthwise direction of a copy sheet P transported along the transport path 42). The flange portions 471*a* extend vertically. Each flange portion 471*a* is formed with two engaging claws 471*b* projecting outward.

Similar to the guide member 471, the guide member 472 is formed with a flange portion 472*a* at opposite ends thereof extending vertically. Each flange portion 472*a* is formed with cutaways 472*b* engageable with the corresponding engaging claw 471*b*.

With this arrangement, when the flange portion 471*a* of the guide member 471 and the flange portion 472*a* of the guide member 472 are assembled with a one-to-one relationship so as to fittingly engage the engaging claw 471*b* in the corresponding cutaway 472*b*, the guide members 471 and 472 are assembled together to form a one piece unit, i.e., the second inverting guide 47, as shown in FIG. 3.

Thus, according to this embodiment, when the guide members 471 and 472 are engageably mounted to each other by the engagement of the engaging claw with the cutaway (i.e., without using fastening means) to form the second inverting guide 47 in one piece unit, a clearance is defined between the guide members 471 and 472 corresponding to the guide space GS. Accordingly, the sheet guiding ability of the second inverting guide 47 is improved, because the positional accuracy of the clearance (guide space GS) defined between the guide members 471 and 472 is easily obtained due to one piece unit arrangement.

Further, compared to the conventional copy sheet guide structure in which the guide plates are assembled to each other by fastening means, workability in assembling parts is remarkably improved, and hence reducing the production cost for the apparatus as a whole, because the guide members 471 and 472 are put together as the one piece unit by merely engageably assembling the guide members 471 and 472 together.

As shown in FIG. 3, each of side portions 471*c* of the guide member 471 is formed with bosses 471*d* (two bosses in this embodiment). Each boss 471*d* (corresponding to second positioning member) projects toward a corresponding side wall 9 constituting the frame main body of the apparatus. The side walls 9 and 9 oppose to each other in the widthwise direction of a copy sheet transported along the sheet transport path 42. Each side wall 9 is formed with two holes (corresponding to first positioning member) 91 and 91 to fittingly receive the corresponding bosses 471*d* and 471*d* of the guide member 471.

With this arrangement, when the bosses 471*d* and 471*d* of each side portion 471*c* of the second inverting guide 47 are inserted in the corresponding holes 91 and 91 of each side wall 9, the second inverting guide 47 is accurately positioned relative to the side walls 9 and 9 and fixedly mounted thereon. Thus, the second inverting guide 47 is fixedly positioned on the transport path 42 with high precision to reliably guide a copy sheet that has passed the first inverting guide 46 toward the copy sheet discharge unit 6.

Figure 5:
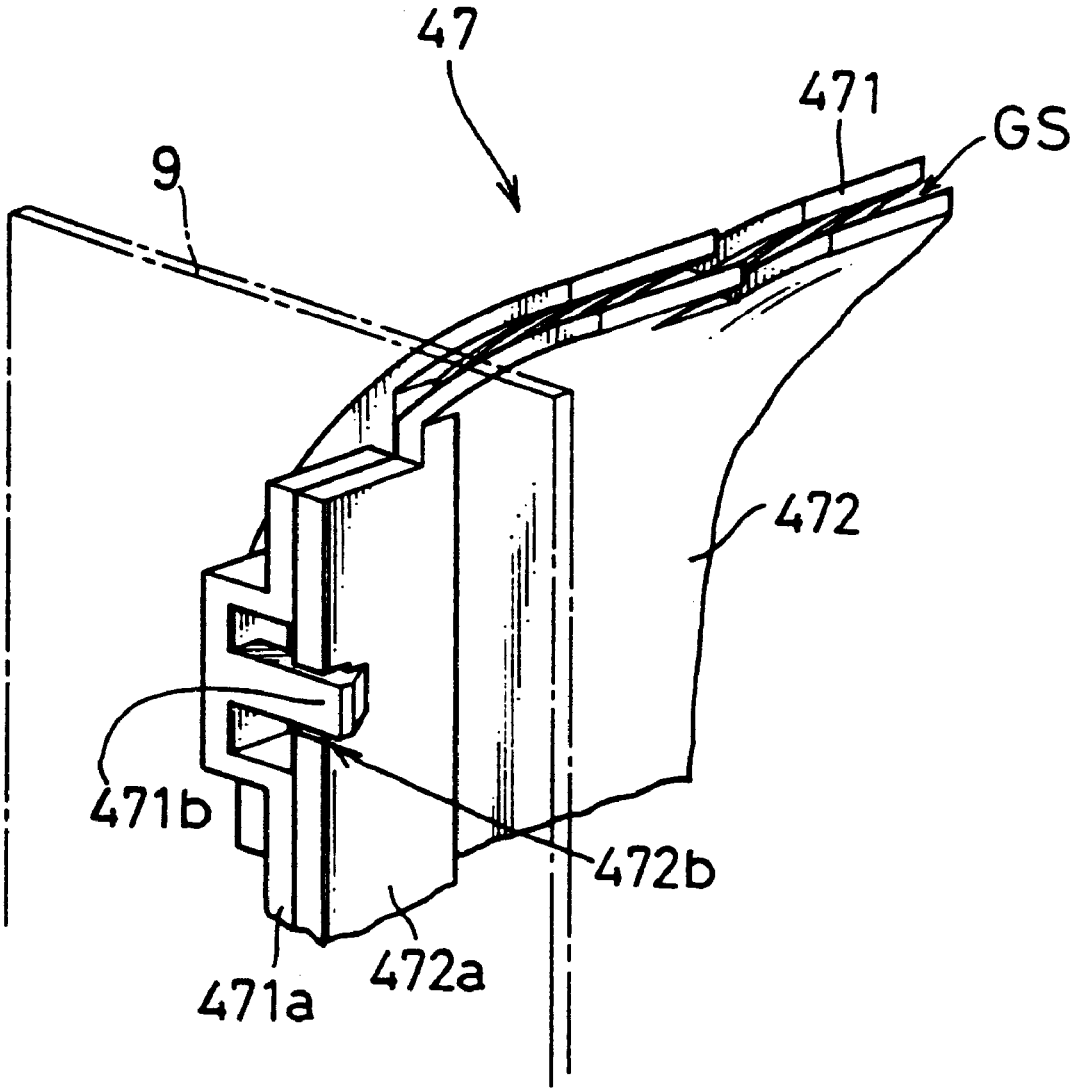
FIG. 5 is a partially enlarged perspective view of the second inverting guide mounted on a side wall.

Further, according to this embodiment, as shown in FIG. 5, the flange portion 471*a* of the guide member 471 and the flange portion 472*a* of the guide member 472 come into fittingly contact with the side wall 9. Thereby, there can be eliminated a possibility that the engaging claw 471*b* may be disengaged from the cutaway 472*b*, and a possibility that the guide member 471 may be displaced from the guide member 472 and vice versa. How these possibilities can be eliminated is described with reference to FIG. 6.

Figure 6:
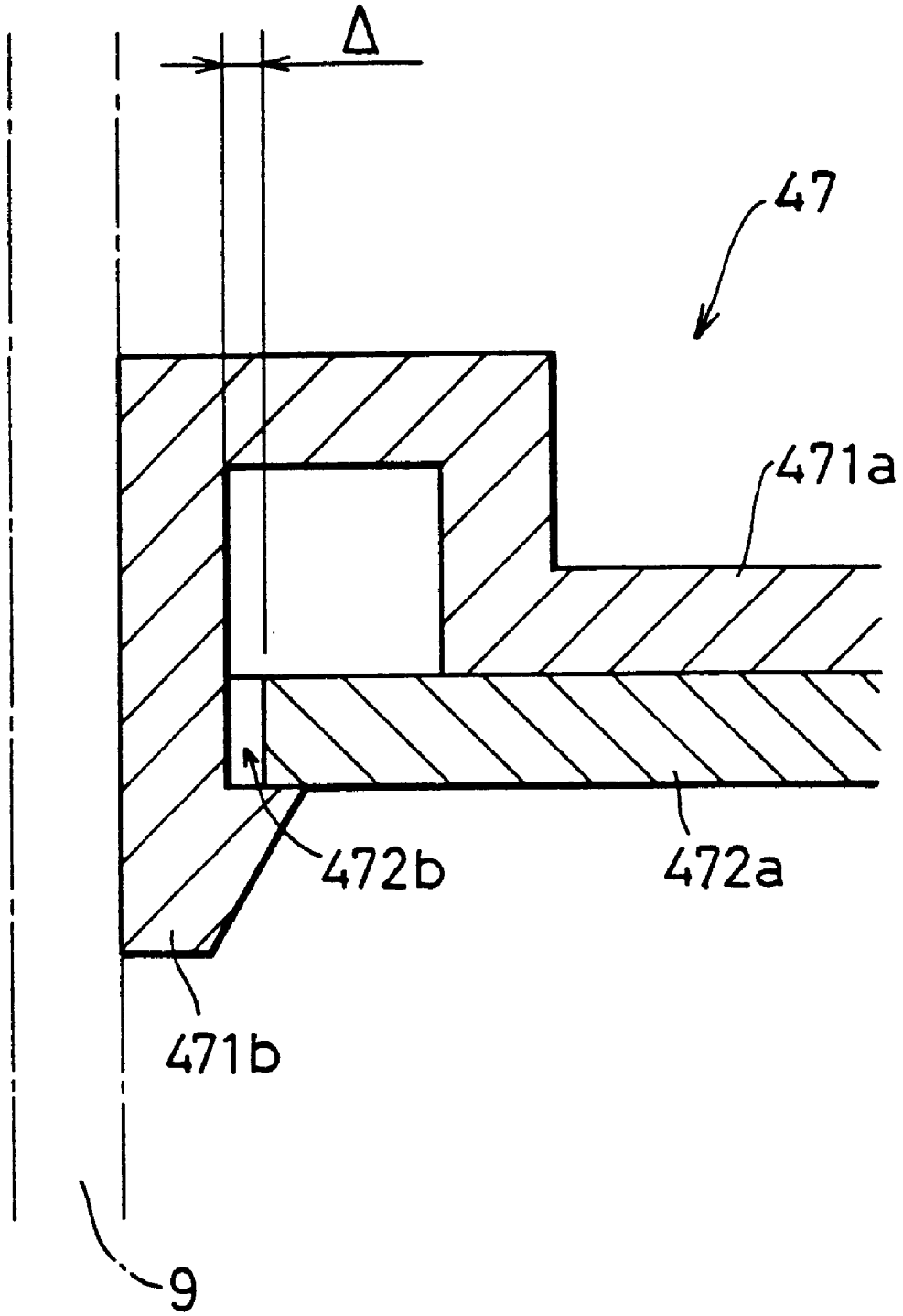
FIG. 6 is a partially enlarged cross sectional view of the second inverting guide mounted on the side wall.

FIG. 6 is a partially enlarged cross sectional view of the second inverting guide 47 mounted on the side wall 9. When the second inverting guide 47 is mounted on the side wall 9, as shown in FIG. 6, the engaging claw 471*b* is held in the cutaway 472*b* which is closed by the side wall 9. In order to disengage the engaging claw 471*b* from the cutaway 472*b*, it is required to push the engaging claw towards the side wall 9. However, such movement is prohibited because the engaging claw has already been in contact with the side wall 9, thus making it impossible to disengage the engaging claw 471*b* from the cutaway 472*b*.

Since this embodiment adopts the arrangement where the engaging claw 471*b* is engageably fitted in the cutaway 472*b*, the relative displacement of the guide members 471 and 472 should not occur as far as the displacement is kept within the range of A that corresponds to the maximum movable amount between the engaging claw 471*b* and the cutaway 472*b* in an engaged state. Accordingly, it can be theoretically said that the relative displacement of the guide members 471 and 472 does not substantially exist.

According to this embodiment, the guide member 471 (outer side guide member) is formed with the engaging claw 471*b*, while the guide member 472 (inner side guide member) is formed with the cutaway 472*b*. This invention, however, is not limited to this embodiment. For example, it will be well understood that the engaging claw and the cutaway may be arranged in the opposite way, i.e., the engaging claw on the inner side guide member and the cutaway on the outer side guide member.

Further, in this embodiment, the combination of engaging claw and cutaway realizes formation of one piece unit. However, any combination other than this one attains the same effect as long as such combination enables to integrate the guide members 471 and 472 into one piece unit.

According to this embodiment, the boss 471*d* provided on the side portion 471*c* of the guide member 471 corresponds to the second positioning member, while the positioning hole 91 formed in the side wall 9 corresponds to the first positioning member. When the boss 471*d* is fittingly inserted in the corresponding positioning hole 91, the second inverting guide 47 is positioned relative to the side walls. On the other hand, the guide member 471 may be formed with a positioning hole, while the side wall 9 may be formed with a boss to be fittingly inserted in the corresponding positioning hole.

The positioning mechanism for positioning the second inverting guide 47 to the side walls 9 and 9 is not limited to the above. As an altered form, one of the side walls may be formed with the first positioning member, and the corresponding one of the side portions of the second inverting guide 47 may be formed with the second positioning member, while the other one of the side walls may be formed with the second positioning member, and the other one of the side portions of the second inverting guide 47 may be formed with the first positioning member, respectively. In this state, these first and second positioning members may be engaged with each other to attain relative positioning of the guide member 47 with the side walls 9 and 9.

Further, in the aforementioned embodiment, the positioning of the second inverting guide 47 is a relative positioning with respect to the side walls 9 and 9. However, the relative positioning is not necessarily performed with respect to both side walls 9 and 9. Instead of both sides positioning, the same effect as mentioned above is obtainable for one side positioning where the guide member 47 is positioned relative to one side wall.

In the foregoing embodiment, the guide structure according to this invention has been described with reference to the arrangement of the second inverting guide 47. The other guide members 43 to 46 may also adopt the same arrangement as the second inverting guide 47. In other words, this invention is applicable to any copy sheet guide structure other than the second inverting guide 47.

Furthermore, we have described the embodiment for the case where this invention is directed to an image forming apparatus (compound machine) having functions as copying machine and facsimile machine. However, this invention is not limited to the compound machine, and may be applicable to an image forming apparatus merely provided with a copying function of copying an original image read by an image scanner (image reader unit) onto a copy sheet by an image recorder unit.

Moreover, it is well understood that this invention is also applicable to a compound machine having functions as copying machine and printer, and a compound machine having functions as copying machine, facsimile machine, and printer.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A copy sheet guide structure for use in an image forming apparatus in which an electrostatic latent image formed on a photoreceptor is developed into a toner image, and the toner image is transferred onto a copy sheet transported along a specified transport path, the guide structure comprising:

a pair of curved guide members arranged on the transport path; and assembly-holding devices on the curved guide members providing for assemblying and holding the curved guide members together to form a one piece unit and define a curved guide space to guide the copy sheet when the guide members are assembled and held together into the one piece unit.

2. A copy sheet guide structure for use in an image forming apparatus in which an electrostatic latent image formed on a photoreceptor is developed into a toner image, and the toner image is transferred onto a copy sheet transported along a specified transport path, the guide structure comprising:

a pair of side walls provided in the image forming apparatus on opposite sides in a widthwise direction of the copy sheet transported along the transport path, at least one of the side walls being provided with a first positioning member; and a pair of guide members arranged on the transport path, the guide member corresponding to the side wall having the first positioning member being provided with a second positioning member, the first positioning member being engaged with the second positioning member to fix a relative position of the guide members to the side walls and thereby form a one piece unit and define a guide space to guide the copy sheet.

3. The copy sheet guide structure according to claim 2, wherein one of the guide members has an engaging claw, the other one of the guide members has a cutaway engageable with the engaging claw to set the guide members as the one piece unit when the engaging claw is engaged in the cutaway, and the engaging claw-is held in the cutaway by the side wall when the guide members are positioned with respect to the side wall.

4. An image forming apparatus comprising:

copy sheet transport means including at least one copy sheet guide structure for transporting a copy sheet along a transport path defined by the copy sheet guide structure;

image recording means for forming a toner image on a photoreceptor to transfer the toner image onto the copy sheet transported by the copy sheet transport means;

the copy sheet guide structure including a pair of curved guide members, and assembly-holding devices which provide for assemblying and holding the curved guide members together to form a one piece unit for defining a curved guide space to guide the copy sheet.

5. An image forming apparatus comprising copy sheet transport means including at least one copy sheet guide structure for transporting a copy sheet along a transport path defined by the copy sheet guide structure, image recording means for forming a toner image on a photoreceptor to transfer the toner image onto the copy sheet transported by the copy sheet transport means;

a pair of side walls provided on opposite sides in a widthwise direction of the copy sheet transported along the transport path, at least one of the side walls being formed with a first positioning member;

the copy sheet guide structure including a pair of guide members, said first positioning member fixing a relative position of one of the guide members with respect to the side walls to form an integrated one piece unit for defining a guide space to guide the copy sheet.

6. The image forming apparatus according to claim 5, wherein another of the guide members has a second positioning member for fixing a relative position of another guide member with respect to the side walls when the second positioning member is engaged with the first positioning member.

7. The image forming apparatus according to claim 6, wherein one of the guide members has an engaging claw while the other one of the guide members has a cutaway, and when the engaging claw is engaged with the cutaway, the guide members are united together to form a one piece unit.

8. The image forming apparatus according to claim 7, wherein the engaging claw is held in the cutaway by the side walls when the relative position of the guide members with respect to the side walls is fixed.

9. A sheet guide structure for guiding a sheet along a transport path comprising:

a pair of spaced walls disposed on opposite sides of said transport path;

first and second guide members;

a first device for assemblying and holding said first guide member to at least one of said spaced walls; and a second device for assemblying and holding said second guide member to said first guide member;

said second guide member being free of attachment to said spaced walls such that a relative position between said first and second guide members is determined by said second device to thereby enhance sheet guiding ability.

10. A sheet guide structure according to claim 9 wherein the sheet guide structure is used in an image forming apparatus in which an electrostatic latent image formed on a photoreceptor is developed into a toner image, and the toner image is transferred onto a copy sheet transported along the transport path.

11. A sheet guide structure according to claim 9 wherein said first and second sheet guide members are curved.

12. A sheet guide structure according to claim 9 wherein the second assembly device includes an engaging claw on one of the guide members and an engageable part on the other one of the guide members, said engaging claw being engageable with the engageable part to set the guide members as a one piece unit, the engaging claw being held in the engageable part by the spaced walls.

13. A sheet guide structure according to claim 12 wherein said engaging claw is flexible.

14. A sheet guide structure according to claim 9 wherein said first device comprises a pair of elements for assemblying and holding said first guide member to both of said spaced walls.

15. A sheet guide structure according to claim 9 wherein said second device comprises a pair of elements for assemblying and holding said second guide member to said first guide member.

16. A sheet guide structure according to claim 9 wherein said first device includes a generally smooth walled projection and a generally smooth walled opening, said projection being slidable into and out of said opening.

17. A sheet guide structure according to claim 16 wherein said projection is an elongate projection having a first elongate axis generally perpendicular to said transport path, said opening being an elongate opening having a second elongate axis generally perpendicular to said transport path, said first and second elongate axes being generally coincident with one another when said projection is disposed within said opening.

18. A sheet guide structure according to claim 17 wherein said projection is slidable into and out of said opening along said first elongate axis.

19. A sheet guide structure for guiding a sheet along a transport path comprising:

wall means disposed along said transport path;

first and second guide members;

a first means for assemblying and holding said first guide member to said wall means; and a second means for assemblying and holding said second guide member to said first guide member;

said second guide member being non-fixed to said wall means such that a relative position between said first and second guide members is determined by said second means to thereby enhance sheet guiding ability.

20. A sheet guide structure according to claim 19 wherein said second means includes a flexible claw member movable between a first position in which the claw member is flexed to facilitate assembly of said first and second guide member and a second position in which the claw member is engaged by said wall means to hold said second guide member to said first guide member.

* * * * *